United States Patent [19]

McNeill

[11] 4,083,091

[45] Apr. 11, 1978

[54] METHOD FOR DEVELOPING BULK IN A STRAND OF SYNTHETIC TEXTILE YARN

[75] Inventor: William Allen McNeill, Gastonia, N.C.

[73] Assignee: Akzona Incorporated, Asheville, N.C.

[21] Appl. No.: 777,771

[22] Filed: Mar. 15, 1977

Related U.S. Application Data

[63] Continuation of Ser. No. 310,476, Nov. 29, 1972, abandoned, which is a continuation-in-part of Ser. No. 169,001, Aug. 4, 1971, abandoned.

[51] Int. Cl.[2] ..... D02G 1/00

[52] U.S. Cl. ..... 28/281

[58] Field of Search ..... 28/1 SM, 1.2, 21, 62, 28/72.11, 72.17, 72 HR, 72 SP, 72.12, 281; 23/290; 264/342 R, 342 RF, 346

[56] References Cited

U.S. PATENT DOCUMENTS

| | | | |
|---|---|---|---|
| 3,099,064 | 7/1963 | Haynes | 28/72 HR |
| 3,159,902 | 12/1964 | Mertens | 28/72.1 |
| 3,341,911 | 9/1967 | Smith | 28/21 |
| 3,397,437 | 8/1968 | McNeill et al. | 28/72 SP |
| 3,619,875 | 11/1971 | Gates | 28/72 SP |
| 3,644,968 | 2/1972 | Elliott et al. | 28/1.2 |
| 3,729,831 | 5/1973 | Kosaka et al. | 28/72 HR |
| 3,785,017 | 1/1974 | Jacobs et al. | 28/72 HR |

*Primary Examiner*—Louis K. Rimrodt

*Attorney, Agent, or Firm*—Richards, Shefte & Pinckney

[57] ABSTRACT

A strand of synthetic textile yarn is fed continuously in a relaxed condition downwardly through a bulking chamber having a series of vertically spaced successive baffle plates with adjacent baffle plates extending from opposite sides of the chamber and at opposite downward inclinations in the path of the downwardly feeding yarn for haphazard curling of the yarn at the plates and progressively greater accumulation of yarn at each successive plate. Steam is applied to the yarn accumulation at the lowermost baffle plate and suction means above the chamber imposes an upward draft to the steam, with the steam acting on the relaxed and accumulated yarn for substantially complete development of bulk therein. The bulked yarn falls between and from the baffle plates onto a reciprocating plate that acts to loosen the bulked yarn and minimize entanglements. The yarn is allowed to fall from the reciprocating plate in a free condition without substantial loss of the developed bulk and is collected in a container in free-falling condition with the container being portable to allow subsequent treating of the bulked yarn therein without further direct handling of the yarn.

12 Claims, 9 Drawing Figures

METHOD FOR DEVELOPING BULK IN A STRAND OF SYNTHETIC TEXTILE YARN

CROSS-REFERENCES TO RELATED APPLICATIONS

This application is a continuation of U.S. patent application Ser. No. 310,476, filed Nov. 29, 1972, which is abandoned concurrently with the filing of the present application, and which was a continuation-in-part of U.S. patent application Ser. No. 169,001, filed Aug. 4, 1971, now abandoned.

BACKGROUND OF THE INVENTION

The present invention is directed to processing of synthetic yarn to develop bulk in the yarn by crimping and shrinking the yarn through the application of heat and moisture to the yarn when in a relaxed condition. The development of bulk in yarn is desired where increased coverage of the yarn in fabrics is beneficial, as in clothing and especially in carpets. A fully bulked yarn will provide softness and coverage in carpets with a lesser amount of yarn than when non-bulked or only partially bulked yarn is used.

Conventionally, yarn is bulked by steaming the yarn in relaxed skeins, or in stuffer boxes, by feeding the yarn through crimping rollers, by conveying the yarn in an air jet that causes the yarn to bulk when the air jet is dissipated into the atmosphere or against a baffle, or by passing the yarn through a heating chamber in a somewhat relaxed condition. However, none of these conventional processes provide optimum bulking as the yarn is not fully relaxed and in some instances is not subjected to heat and moisture for a sufficient period to allow full bulk development. Further, in the case of skein handling, which is the most common bulking process, the yarn is not uniformly relaxed with the result that non-uniform bulking occurs, producing detectable streaks in fabrics, such as carpet, made from the yarn.

By the present invention, yarn is handled in a continuous process with the yarn being substantially completely relaxed in haphazardly curled condition while heat and moisture are applied for substantially complete bulk development, and the bulked yarn is discharged in fully relaxed condition for subsequent treatment without further direct handling that could reduce the bulk before heat-setting or other treatment. Thus, the present invention obtains optimum and uniform bulking of yarn to an extent that is not attainable by any previously known process, and does so in a simple and reliable manner and at high production rates.

SUMMARY OF THE INVENTION

Briefly described, the method of the present invention develops bulk in a strand of synthetic textile yarn by feeding the yarn continuously in a generally downward direction and in a substantially tensionless condition while partially obstructing the generally downwardly fed yarn to cause it to be substantially completely relaxed. Heat and moisture, preferably in the form of steam, are applied to the partially obstructed and relaxed yarn for substantially complete development of bulk therein, and the thus bulked yarn is allowed to fall downwardly in a free condition without substantial loss of the developed bulk.

In the preferred embodiment of the method of the present invention, the yarn is obstructed sufficiently to cause it to curl haphazardly and form an accumulation for enhanced bulk development, with the obstructing being performed at a plurality of successively spaced locations between and from which the yarn is allowed to fall and to accumulate in progressively greater amounts at each successive obstructing location. Steam is applied to the yarn accumulation at the last of the successive obstructing locations and an upward draft is imposed on the steam to cause it to flow upwardly through the locations for application to the yarn thereat. To provide optimum relaxation and accumulation of the yarn at the obstructing locations, the direction of the generally downward feeding of the yarn is adjustable. As the bulked yarn falls from the last of the obstructing locations it is reciprocated laterally to loosen it and minimize entanglements. It is then collected in free-falling condition for subsequent heat-setting treatment without requiring any further direct handling of the yarn that could reduce the developed bulk.

The apparatus of the present invention comprises a generally vertically extending bulking chamber through which yarn may be fed, means for feeding yarn continuously in a generally downward direction into the bulking chamber in a substantially tensionless condition, means for applying heat and moisture, preferably in the form of steam, to the yarn in the bulking chamber, and means for partially obstructing the yarn in the bulking chamber. The yarn obstructing means includes at least one baffle plate disposed in the path of the yarn to obstruct partially the generally downward feeding of the yarn and thereby cause the yarn to be substantially completely relaxed at the baffle plate for substantially complete development of bulk in the yarn by the influence of the applied heat and moisture. The baffle plate is inclined downwardly to allow the yarn to fall freely therefrom for discharge from the chamber in relaxed and bulked condition.

In the preferred embodiment of the apparatus of the present invention, the obstructing means comprises a plurality of vertically spaced successive baffle plates with adjacent plates extending from opposite sides of the bulking chamber and at opposite downward inclinations for advancement of the relaxed yarn successively to each baffle plate, with the baffle plates being relatively disposed to provide for haphazard curling and accumulation of the downwardly feeding yarn at the plates and progressively greater accumulation of yarn at each successive baffle plate. Steam is applied to the yarn accumulated on the baffle plates, and downwardly opening suction means is disposed above the bulking chamber to impose a draft to draw the steam upwardly through the curled and accumulated yarn in the chamber. A reciprocating, trough-shaped plate is located in the yarn path below the last baffle plate so that the bulked yarn is reciprocated thereon to loosen the yarn and minimize entanglements. This reciprocating plate is inclined to allow the bulked yarn to fall freely therefrom. Disposed below the bulking chamber and reciprocating plate is a collection container that collects the relaxed bulked yarn in a free-falling condition without loss of the developed bulk, the container being portable to allow subsequent treating of the bulked yarn therein without further direct handling of the yarn.

The preferred yarn feeding means comprises a pair of rollers disposed above the bulking chamber and forming a nip through which the yarn is fed. One of these rollers is driven to feed the yarn continuously to the bulking chamber, and the other roller is adjustable about the periphery of the driven roller for varying the location of the nip to adjust the downward direction of the yarn feed to obtain optimum yarn relaxation and accumulation at the baffle plates.

By the present invention as described heretofore, substantially complete and uniform bulk development is obtained in a simple and reliable manner and with collection of the bulked yarn in a free relaxed condition that avoids loss of the developed bulk in collection or in subsequent treating, and with overall results superior to any previously known processes.

DESCRIPTION OF THE PREFERRED EMBODIMENT

Figure 1:
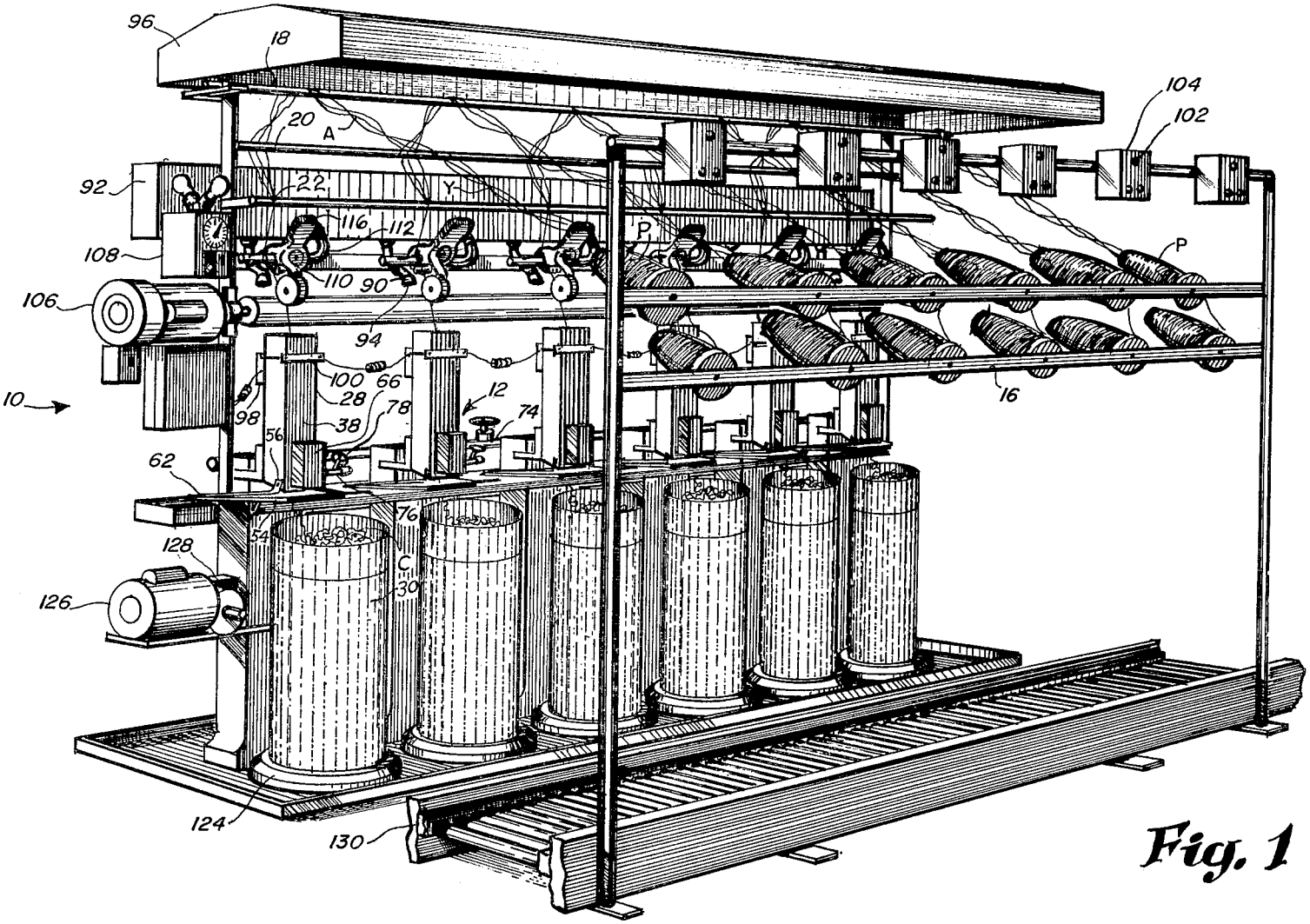
FIG. 1 is a perspective view of an apparatus for developing bulk in a strand of synthetic textile yarn according to the preferred embodiment of the present invention.

In the preferred embodiment illustrated in the accompanying drawings, the yarn bulking apparatus 10 of the present invention is constructed for separate and simultaneous processing of a plurality of yarn strands Y at individual stations 12, with the various components of the apparatus 10 mounted on a frame 14 to which the yarn strands Y are fed for processing from supply packages P mounted on a supply rack 16 that is spaced from the front of the frame 14. A feed-in section A of each yarn strand Y extends from its supply package P over an upper horizontal guide rod 18 extending along the top of the frame 14, behind a lower horizontal guide rod 20 extending along the frame 14 below and slightly to the rear of the upper guide rod 18, through an eyelet 22 mounted on the frame 14 below and forward of the lower guide rod 20, through the nip of a pair of feed rollers 24, 26, and into a bulking chamber 28 wherein the section B of the yarn strand Y therein is bulked in the manner described below, and from which chamber 28 the bulked section C of the yarn strand Y is discharged into a rotating collection can 30 that is disposed directly below the bulking chamber 28.

The bulking chamber 28 is mounted on the frame 14 in generally vertical disposition and is open at its upper and lower ends to allow the yarn strand Y to be fed therethrough by the aforementioned feed rollers 24, 26, which serve as means for feeding yarn continuously in a generally downward direction into the bulking chamber 28 in a substantially tensionless condition. Within the bulking chamber 28 is means for partially obstructing the generally downwardly feeding yarn and means for applying heat and moisture to the yarn.

The means for partially obstructing the downwardly feeding of the yarn includes at least one and preferably a plurality of baffle plates. In the illustrated embodiment there are three vertically spaced successive baffle plates 32, 34, 36 disposed in the path of the yarn section B with adjacent baffle plates extending from opposite sides 38, 40 of the bulking chamber at opposite downward inclinations for partial obstruction of the yarn to cause it to be substantially relaxed for substantially complete development of bulk in the yarn by the influence of the applied heat and moisture, with the inclination of the baffle plates 32, 34, 36 allowing the yarn to advance successively to each baffle plate and to fall freely therefrom for discharge from the bulking chamber 28 in relaxed and bulked condition.

The first baffle plate 32 and the third or last baffle plate 36 are both formed by bends in a single metal strip 42 that extends across the full width of the forward side 38 of the bulking chamber 28. The top 44 of the metal strip 42 is formed as a hook for engagement over the top edge of the forward side 38 of the bulking chamber 28 for mounting of the strip 42 therein. The strip 42 extends vertically from the top 44 thereof along the forward side 38 of the bulking chamber 28 to the location of the first baffle plate 32, at which the strip is bent to form the first baffle plate 32 at a straight inclination, at the lower end of which the strip is bent back to extend to the forward side 38 of the bulking chamber 28, along which the strip extends to the location of the third baffle plate 36 at which the strip is again bent to form the third baffle plate 36. This third baffle plate 36 extends from the forward side 38 of the bulking chamber at an initial straight inclination and then curves downwardly and back to the forward side 38 at which the strip 42 terminates. The curvature of the third baffle plate 36 facilitates generally downward discharge of the bulked yarn section C from the bulking chamber 28.

The second baffle plate 34 is formed in a metal strip 46 that extends across the full width of the rearward side 40 of the bulking chamber 28. The top 48 of this metal strip 46 is formed as a hook for engagement over the top edge of the rearward side 40 of the bulking chamber 28 for mounting of the strip 46 therein. The strip 46 extends vertically from the top 48 thereof along the rearward side 40 of the bulking chamber 28 to the location of the second baffle plate 34, which is vertically intermediate the first and third baffle plates 32, 36. This second baffle plate 34 is formed by simple bending of the strip 46 to form a straight inclination and reversely bending the strip 46 for return to the rearward side 40 of the bulking chamber 28, along which the strip 46 extends to the bottom of the bulking chamber 28 at which the strip 46 is inwardly bowed to provide a yarn deflecting surface 50 that serves to direct the bulked yarn section C downwardly into the collection can 30 when the direction of the falling yarn causes the yarn to contact the deflecting surface 50. The metal strip 46 terminates in a downwardly and rearwardly extending end portion 52 that extends beyond the horizontal extent of the collection can 30 so that any condensate accumulating on the strip 46 or deposited thereon from the bulking chamber 28 will flow thereon for dripping therefrom away from the collection can 30, thereby avoiding any dripping of moisture onto the bulked yarn section C in the can 30.

Dripping of condensate into the collection can 30 is also prevented by a condensate collecting drip pan 54 mounted by flanges 56 to the bottom of the forward portion of the bulking chamber 28 at a spacing from the aforementioned yarn deflecting surface 50 sufficient to allow the yarn to fall therebetween. This drip pan 54 has an upwardly and forwardly inclined flange 58 extending from its rearward edge into the bulking chamber 28 to prevent the bulked yarn section B from contacting the condensate in the drip pan 54. To facilitate flow of condensate to the drip pan 54, the bottom of the bulking chamber 28 is formed with downwardly and forwardly extending edges 60 along which condensed moisture flows to the drip pan 54. A downwardly and rearwardly extending trough 62 is formed at one side of the drip pan 54 to carry condensed moisture therefrom to a main drain pan 64 mounted on the frame 14 and extending along the apparatus 10 for draining of condensed moisture from each of the stations 12.

As the baffle plates 32, 34 and 36 are formed in metal strips 38, 40, their inclinations can be varied by bending the strips to obtain optimum bulking for the particular rate of yarn feed and yarn size being processed. The inclinations are such that the baffle plates 32, 34, 36 obstruct the downwardly feeding yarn section B sufficiently to provide haphazard curling and accumulation on the plates with progressively greater accumulation of yarn at each successive baffle plate and a substantial accumulation at the third or last baffle plate 36. This not only produces substantially complete relaxation of the yarn but also produces a substantial period of dwell of the relaxed yarn in the bulking chamber 28 for optimum bulking by the influence of the applied heat and moisture.

The means for applying heat and moisture to the relaxed yarn section B in the bulking chamber 28 includes a steam chamber 66 mounted on the outside of the forward side 38 of the bulking chamber 28 at the lower portion thereof. This steam chamber 66 is divided by a horizontal grate 68 into a lower section 70 and an upper section 72. Steam from a main steam line 74 that serves all of the stations 12 is introduced through a branch steam line 76 into the lower section 70 of the steam chamber 66. A valve 78 is located in the branch steam line 76 to shut off or control the steam flow to the steam chamber 66. The upper section 72 of the steam chamber 66 is filled with stuffing 80 of thin stainless steel ribbons, which are introduced through an opening 82 that is normally closed by a plug 84. The stuffing 80 is retained in the upper section 72 by the grate 68 which allows steam to flow from the lower section 70 into the upper section 72 where the stuffing 80 disperses the steam for continuous uniform flow through a horizontal series of ports 86 in the forward side 38 of the bulking chamber 28. These ports 86 are located in the area of the third baffle plate 36 so that the space enclosed by the third baffle plate will be filled with steam, which escapes around the edges thereof, but is primarily discharged through a horizontal series of ports 88 in the third baffle plate 36. In this manner the steam is applied to the relaxed yarn section B accumulating on the third baffle plate 36 to develop bulk in the relaxed yarn.

The steam naturally rises in the bulking chamber 28 and thereby acts on the relaxed yarn section B at the first and second baffle plates 32, 34. The rise of steam is facilitated by means for imposing an upward draft in the bulking chamber 28. This means includes a suction conduit 90 that extends from a main suction line 92 that serves all of the stations 12. The suction conduit 90 has a downwardly facing opening 94 located above the feed rollers 24, 26 and thereby creates an upward draft to draw steam through and upwardly from the bulking chamber 28. This draft imposing means also includes a suction hood 96 of conventional construction extending above all of the stations 12.

The amount of steam introduced to the bulking chamber 28 is controlled by adjustment of the valve 78, and to provide an indication of the operating steam conditions a thermostate 98 is mounted by a strap 100 to the upper portion of the bulking chamber 28, and through a conventional electrical system operates lights 102 mounted in a signal box 104 on the aforementioned supply rack 16 so that the operator can tell whether proper operating conditions are being maintained.

As mentioned above, the yarn Y is fed to the bulking chamber 28 by the feed rollers 24, 26. One of these rollers is a drive roller 24 that is mounted in bearings 25 on the frame 14 and extends horizontally through all of the bulking stations 12 above the bulking chambers 28. This drive roller 24 is driven by an electrical motor 106 mounted at the end of the frame 14. The speed of the motor 106 is adjustable to produce a desired drive roller speed for optimum bulking for the particular size and type of yarn being processed, and a conventional signal box 108 is mounted on the frame 14 in relation to the drive motor 106 to provide an indication when sufficient yarn has been fed through the nip of the rollers 24, 26 to fill the can 30 and require doffing.

The yarn Y is maintained in feeding contact with the drive roller 24 by the other roller 26 which is an idler roller that forms a yarn feeding nip between the rollers 24, 26. This idler roller 26 is freely rotatably mounted at the end of an arm 110 that is pivoted on a mounting rod 112 through a horizontal hinge connection 14. A manipulating handle 116 extends from the arm 110 to allow the operator to raise the idler roller 26 from the driven roller 24 to remove or insert yarn in the nip.

The location of the nip between the rollers 24, 26 with respect to the periphery of the drive roller 24 determines the direction of feed of the yarn Y to the first baffle plate 32 in the bulking chamber 28. This yarn feeding direction is generally downward but is preferably adjustable to obtain optimum curling and accumulation of the yarn at the baffle plates 32, 34, 36 for optimum bulking results. To permit such adjustment, the idler roller mounting rod 112 includes a vertically extending end portion 118 that is adjustably mounted in a bracket 120 on the frame 14. By raising or lowering the vertical end portion 118 in the bracket 120 the location of the idler roller 26 with respect to the periphery of the driven roller 24 is varied, thereby varying the nip location and resultant direction of yarn feed to the bulking chamber 28. A compression spring 122 acting between the handle 116 and the mounting rod 112 normally urges the idler roller 26 in nip forming contact with the driven roller 24.

The aforementioned collection can 30, which is located directly below the bulking chamber 28 for receipt of the free falling relaxed and bulked yarn section C, is a conventional portable type commonly used in the textile industry, being cylindrical in shape and formed with perforations for subsequent treatment of the bulked yarn while in the can 30. For uniform distribution of the yarn in the can 30 during filling, it is supported for continuous rotation on a rotating platform 124 at the base of the frame 14. The platform 124 is rotated by a drive motor 126 mounted on the end of the frame 14, through a conventional gear box 128 and drive connection that are conventional in the textile industry and require no detailed description.

To facilitate handling of empty and filled cans 30, a roller conveyor 130 extends along the length of the apparatus 10 between the supply rack 16 and frame 14 and at a lateral spacing from the frame 14 to allow operator access to the components mounted on the frame 14.

In operation of the apparatus 10 of the illustrated preferred embodiment, yarn Y is drawn by the rollers 24, 26 from the packages P over the guide rods 18, 20, through the eyelet 22 and to the nip of the rollers 24, 26, which feed the yarn in a generally downward adjustable direction and in a substantially tensionless condition to the first baffle plate 32 in the bulking chamber 28. The first baffle plate 32 partially obstructs the yarn and causes it to curl haphazardly and accumulate slightly in a substantially relaxed condition. The relaxed yarn B then falls freely from the first baffle plate 32 to the second baffle plate 34 where it further accumulates and then falls freely to the third baffle plate 36 at which it accumulates substantially and is bulked by the application of steam entering through the ports 88. The steam is drawn upwardly for bulking application on the yarn at the first and second baffle plates 32, 34 by suction imposed by the suction conduit 90 and hood 96. The relaxed bulked yarn C falls freely from the third baffle plate 36, being guided if necessary by the deflecting surface 50, into the collection can 30. When the can 30 is filled, it is removed and sent through further processing, such as a conventional autoclave and drying oven that heatset the bulk in the yarn, without direct handling of the yarn that could remove some of the developed bulk.

Figures 2, 3, 4, 5, 6:
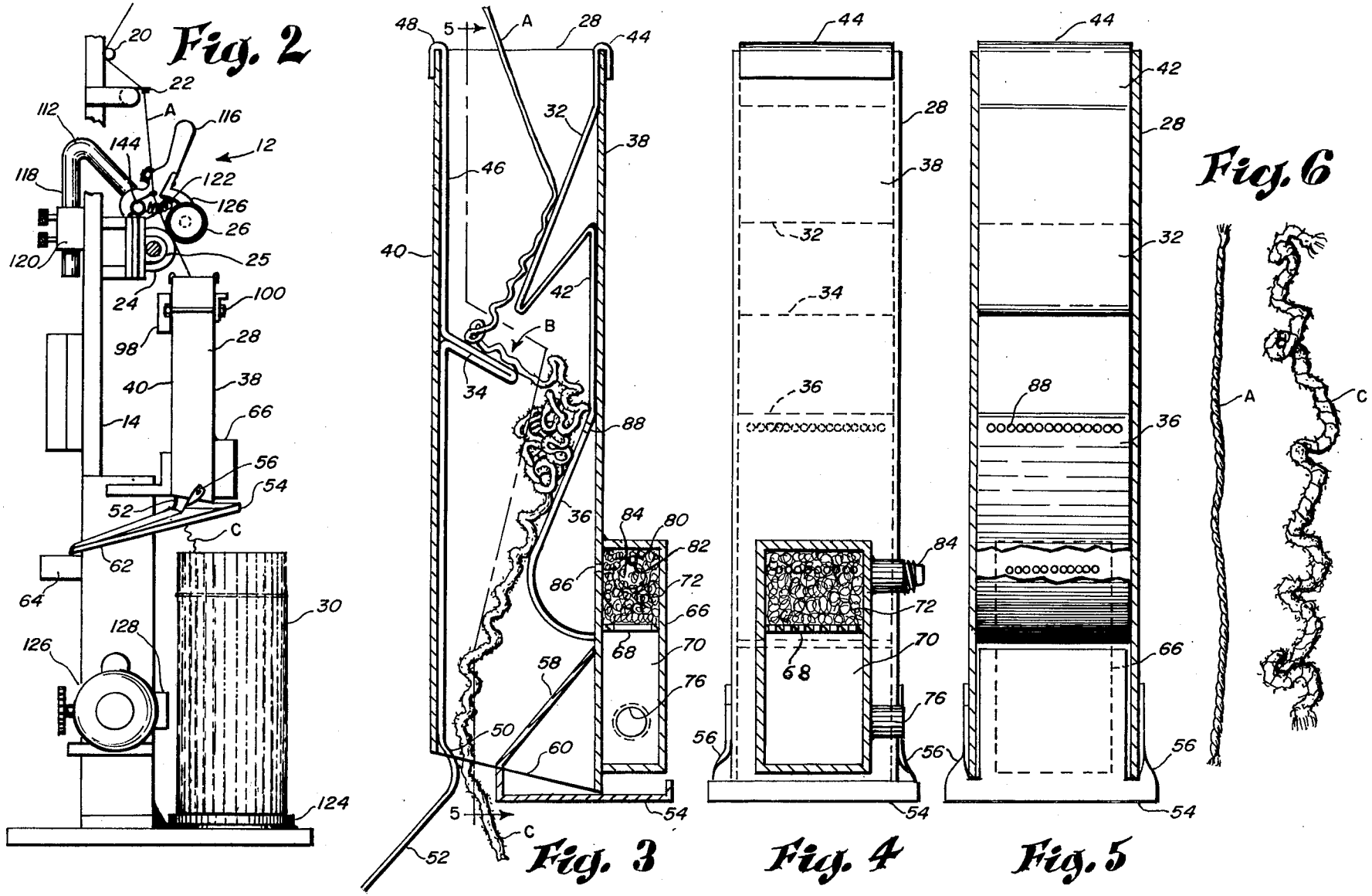
FIG. 2 is an end view of the apparatus of FIG. 1 with some of the components omitted for clarity.
FIG. 3 is a vertical sectional view of the bulking chamber and steam chamber of the apparatus of FIG. 1.
FIG. 4 is a front elevation of the bulking chamber and steam chamber of FIG. 3 with the steam chamber shown in section.
FIG. 5 is a vertical sectional view taken along line 5—5 in FIG. 3.
FIG. 6 is an illustration on a slightly enlarged scale of a comparison of yarn before and after bulking.

By practicing the method and utilizing the apparatus of the present invention, optimum development and retention of bulk is obtained with uniform results and in a high-speed, simple and reliable manner. The bulk development results are obvious from FIG. 6, which shows on a slightly enlarged scale a length of unbulked yarn A and a length of bulked yarn C that was originally identical to the unbulked yarn A and was bulked by the method and with the apparatus of the present invention.

Figure 7:
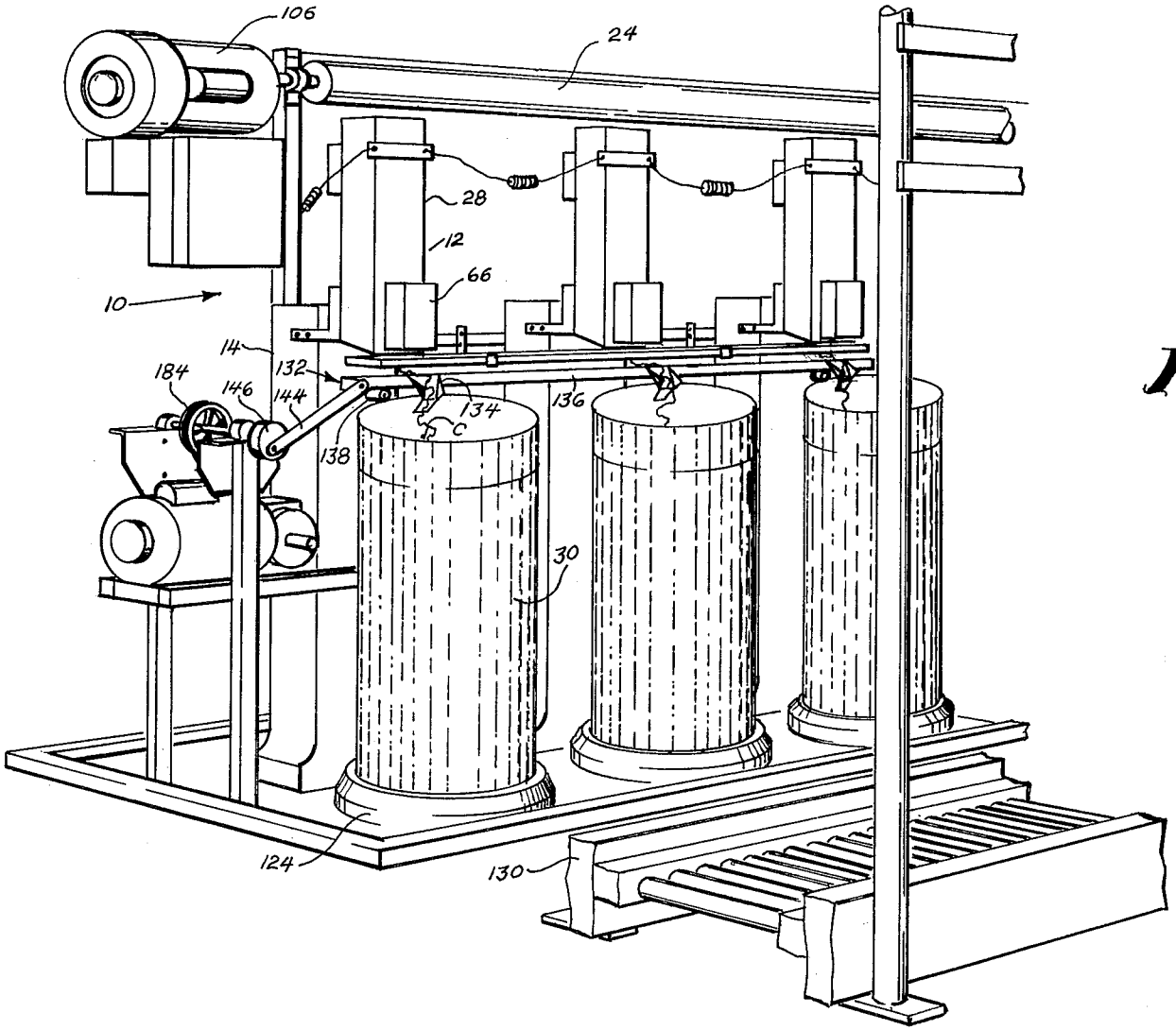
FIG. 7 is a view, similar to FIG. 1, showing means for imparting repetitious lateral motion to the yarn incorporated in the apparatus of FIG. 1.
Figure 8:
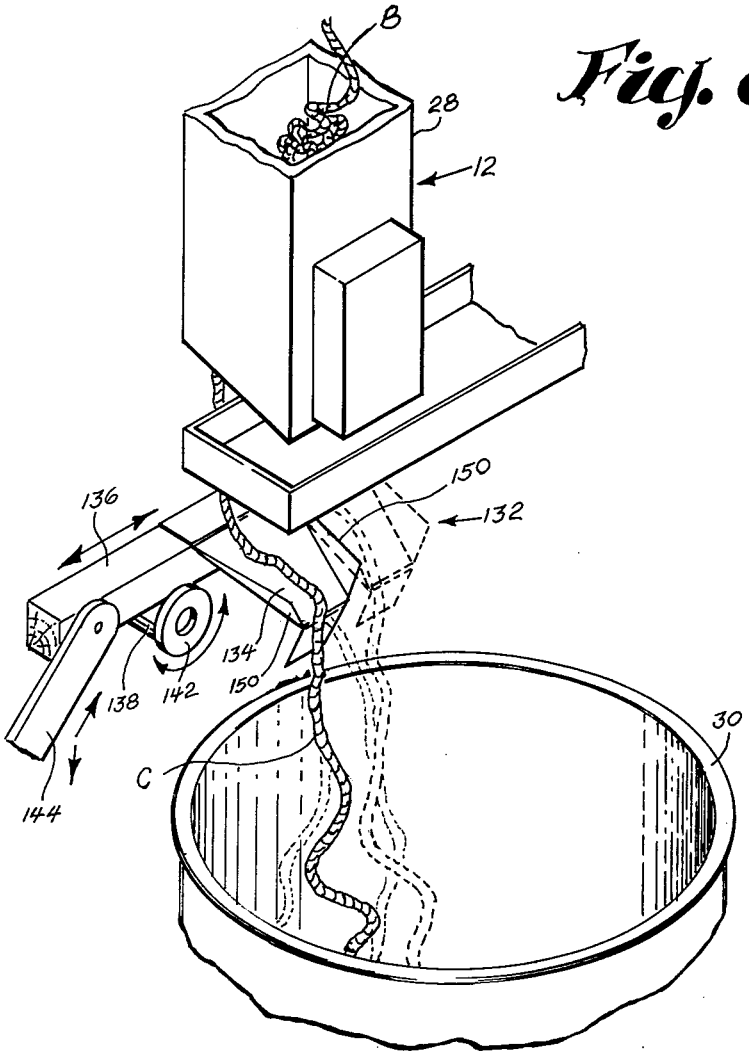
FIG. 8 is an enlargement of the motion imparting means portion of the apparatus of FIG. 7.
Figure 9:
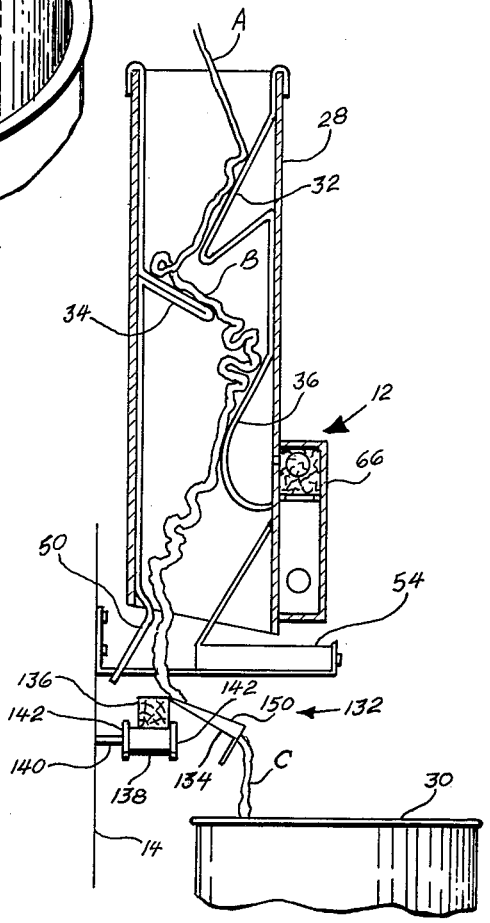
FIG. 9 is a vertical sectional view of the bulking chamber, steam chamber and motion imparting means of the apparatus of FIG. 7.

To enhance the bulking results by loosening the bulked yarn C and thereby minimizing entanglements before collection in the cans 130, means 132 for imparting repetitious lateral motion to the bulked yarn is disposed for action on the yarn C before completion of allowing the yarn to fall downwardly in free condition into the cans 30. This motion imparting means 132 is illustrated in FIGS. 7–9 adapted to an apparatus that is identical in other respects to the apparatus 10 of the preceding figures and like reference numerals are used for identical parts in both sets of drawings. As a matter of fact, there is no difference in function or results as far as the identical parts are concerned as the motion imparting means 132 is located below the last baffle plate 36 and exteriorly of the bulking chamber 28.

The motion imparting means 132 includes means for partially obstructing the yarn C while imparting lateral motion, which obstructing means in the preferred embodiment is an inclined movable plate 134 disposed at each station 12 in the path of the bulked yarn C as it falls from the bottom of the bulking chamber 28. This plate 134 is secured rearwardly of the yarn path to the top of an operating rod 136 that extends the length of the apparatus 10 for securement of a plate 134 thereto at each individual station 12. The rod 136 is supported in horizontal disposition on a plurality of spaced cylindrical rollers 138 that are mounted on horizontal shafts 140 projecting forwardly from the frame 14. These rollers 138 have enlarged ends 142 that retain the rod 136 on the rollers 138 while the rod 136 is free to reciprocate thereon. The rod 136 is reciprocated through a crank arm 144 that has one end pivoted to an end of the rod 136 and its other end pivoted eccentrically on a drive wheel 146 that is driven through a suitable connection 148 by the drive motor 126. The stroke of the crank arm 144 is such that the reciprocation of the rod 136 is limited to retain the upper end of the plates 134 under the yarn path throughout the reciprocating stroke. In this manner the plates 134 are reciprocated laterally generally in the plane of the plates, which are inclined downwardly from the rod 136 toward the center of the cans 30 so that the bulked yarns C will be reciprocated laterally as they pass down the inclined plates 134, thereby loosening the bulked yarn and minimizing possible entanglements in the yarn. In addition to being inclined, the plates 134 are trough-shaped with upstanding sides 150 that confine the yarn to the breadth of the plates 134 during reciprocation.

Thus, as the bulked yarn C falls from the bulking chambers 28 at each station 12, it is obstructed by the movable plate 134, which is reciprocating and, therefore, causes reciprocation of the yarn as it advances down the plate 134, loosening the yarn and minimizing entanglements that may have resulted during accumulation on the baffle plates 32, 34 and 36. The yarn then falls from the end of the plate 134 in free condition into the collection can 30 therebelow.

The present invention may be used to develop bulk in various types and sizes of synthetic textile yarns, including, but not limited to continuous filament and spun yarn of polyester, nylon, or acrylic material. The invention is especially applicable to carpet yarns where the enhanced bulking provides greater coverage with less poundage than conventionally processed yarns, the haphazard curling and relaxed collection produces uniform bulking that avoids the development of visible streaks, and the enhanced bulking provides end definitions that do not flare or open when tufted.

Not only does the present invention produce enhanced bulk development, but it does so at high production rates. The rate depends upon the size of the yarn and the amount of bulking desired, but with all sizes the rate is higher than with other known processes. Rates as high as 900 yards per minute have been utilized successfully with the present invention and even higher rates are considered possible.

Although only one embodiment of the present invention and an addition thereto have been described in detail hereinabove and illustrated in the accompanying drawings, it is to be understood that the scope of the present invention is applicable to many variations and modifications, and is not intended to be limited by this detailed disclosure or otherwise, except as the invention is defined by the appended claims and equivalents thereof.

I claim:

1. A method of developing bulk in a strand of synthetic yarn comprising feeding said yarn continuously in a generally downward direction and in a substantially tensionless condition, providing an obstruction under said generally downwardly feeding yarn to cause said yarn to be substantially completely relaxed, applying heat and moisture to said obstructed relaxed yarn for substantially complete development of bulk therein, and allowing said bulked yarn to fall downwardly in a free condition without substantial loss of the bulk developed therein.

2. A method of developing bulk in a strand of synthetic textile yarn according to claim 1 and characterized further in that said partially obstructing said downward feeding of said yarn obstructs said yarn feeding sufficiently to cause said yarn to curl haphazardly and form an accumulation of relaxed yarn for enhanced bulk development by said applied heat and moisture.

3. A method of developing bulk in a strand of synthetic textile yarn according to claim 2 and characterized further in that said partially obstructing said generally downwardly feeding of said yarn is performed at a plurality of successively spaced locations between and from which said yarn is allowed to fall and at at least one of which said yarn accumulation occurs.

4. A method of developing bulk in a strand of synthetic textile yarn according to claim 3 and characterized further in that said yarn is accumulated in progressively greater amounts at each successive obstructing location.

5. A method of drveloping bulk in a strand of synthetic textile yarn according to claim 4 and characterized further in that said means for applying heat and moisture to said relaxed yarn applies steam to the yarn accumulation at the last of said successive obstructing locations.

6. A method of developing bulk in a strand of synthetic textile yarn according to claim 5 and characterized further by imposing an upward draft on said applied steam to cause it to flow upwardly through said successive obstructing locations.

7. A method of developing bulk in a strand of synthetic textile yarn according to claim 1 and characterized further by adjusting the generally downward direction of feeding of said yarn to obtain optimum relaxation of said yarn by said obstructing of said yarn.

8. A method of developing bulk in a strand of synthetic textile yarn according to claim 1 and characterized further by collecting said bulked yarn in a free-falling condition for subsequent heat-setting treatment without further direct handling of said collected yarn.

9. A method of developing bulk in a strand of synthetic textile yarn according to claim 1 and characterized further by imparting repetitious lateral motion to said bulked yarn before completion of said allowing it to fall downwardly, thereby loosening said bulked yarn to minimize entanglements therein.

10. A method of developing bulk in a strand of synthetic textile yarn according to claim 9 and characterized further in that said imparting repetitious lateral motion imparts a reciprocating lateral motion to said yarn.

11. A method of developing bulk in a strand of synthetic textile yarn according to claim 9 and characterized further by partially obstructing said yarn while imparting said repetitious lateral motion thereto.

12. A method of developing bulk in a strand of synthetic textile yarn according to claim 9 and characterized further in that said imparting repetitious lateral motion is performed after said applying heat and moisture.

* * * * *